US005390592A

United States Patent [19]

Schnell et al.

[11] Patent Number: 5,390,592

[45] Date of Patent: Feb. 21, 1995

[54] DEWATERING PRESS FOR COMPRESSIBLY DEWATERABLE MATERIAL

[75] Inventors: Hans Schnell, Mengen; Armin Volk, Weingarten, both of Germany

[73] Assignee: Sulzer Escher Wyss GmbH, Ravensburg, Germany

[21] Appl. No.: 45,412

[22] Filed: Apr. 9, 1993

[30] Foreign Application Priority Data

| | | | |
|---|---|---|---|
| Apr. 11, 1992 | [DE] | Germany | 4212275 |
| Sep. 11, 1992 | [DE] | Germany | 4230383 |
| Sep. 11, 1992 | [DE] | Germany | 4230384 |
| Sep. 11, 1992 | [DE] | Germany | 4230385 |

[51] Int. Cl.[6] ..... B30B 9/14; B30B 9/18

[52] U.S. Cl. ..... 100/127; 100/117; 100/145; 100/148; 100/149

[58] Field of Search ..... 100/117, 126, 127, 191, 100/145–150, 192

[56] References Cited

U.S. PATENT DOCUMENTS

| | | | |
|---|---|---|---|
| 2,260,865 | 10/1941 | Peterson . | |
| 2,615,387 | 10/1952 | Messing | 100/148 X |
| 3,073,239 | 1/1963 | Cowan et al. | 100/179 |
| 3,527,158 | 9/1970 | Young | 100/117 |
| 3,683,796 | 8/1972 | Miner et al. | 100/149 X |
| 3,715,977 | 2/1973 | MacKenzie | 100/117 |
| 3,777,658 | 12/1973 | Vosskuhler | 100/150 X |
| 4,003,304 | 1/1977 | Reinhall | 100/147 X |
| 4,256,035 | 3/1981 | Neufeldt | 100/145 |
| 4,260,488 | 4/1981 | Condolios | 100/148 X |

FOREIGN PATENT DOCUMENTS

| | | | |
|---|---|---|---|
| 0037041 | 10/1981 | European Pat. Off. . | |
| 0211706 | 2/1987 | European Pat. Off. . | |
| 0219785 | 4/1987 | European Pat. Off. . | |
| 376833 | 8/1907 | France . | |
| 1275477 | 10/1961 | France | 100/117 |
| 1494284 | 9/1967 | France . | |
| 112321 | 8/1900 | Germany . | |
| 445426 | 6/1927 | Germany . | |
| 613378 | 5/1935 | Germany | 100/148 |
| 1931474 | 7/1976 | Germany . | |
| 2908842 | 9/1980 | Germany | 100/117 |
| 3428381 | 2/1985 | Germany | 100/117 |
| 3837331 | 5/1990 | Germany . | |
| 3938579 | 5/1991 | Germany . | |
| 1691136 | 11/1991 | U.S.S.R. | 100/117 |

*Primary Examiner*—Stephen F. Gerrity
*Attorney, Agent, or Firm*—Townsend and Townsend Khourie and Crew

[57] ABSTRACT

A press for the mechanical dewatering of water-containing pulverised solid material is provided with a rotatable feed screw (3) which is so floatably mounted that it can perform a rotary pendular pivoting movement about a swivel point (D) lying in the area of the drive. Thereby, a high dewatering power is achieved with advantagous wear properties of the press. By special formation of the region where the solid material leaves the feed section (3), the effect and operating behavior can be further improved.

23 Claims, 3 Drawing Sheets

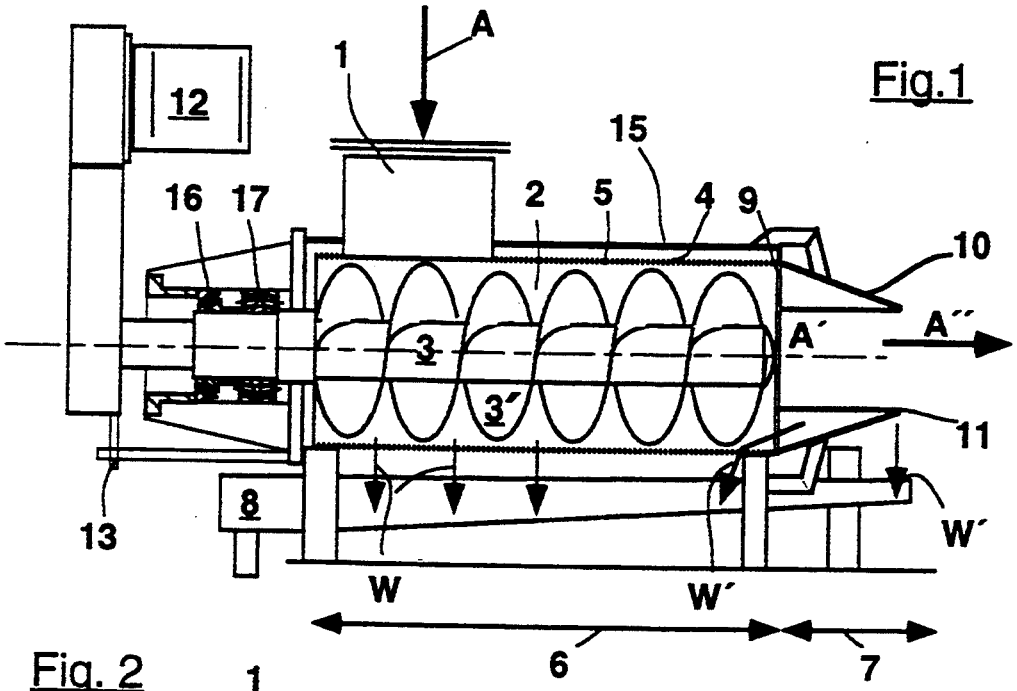
Fig.1
Fig. 2
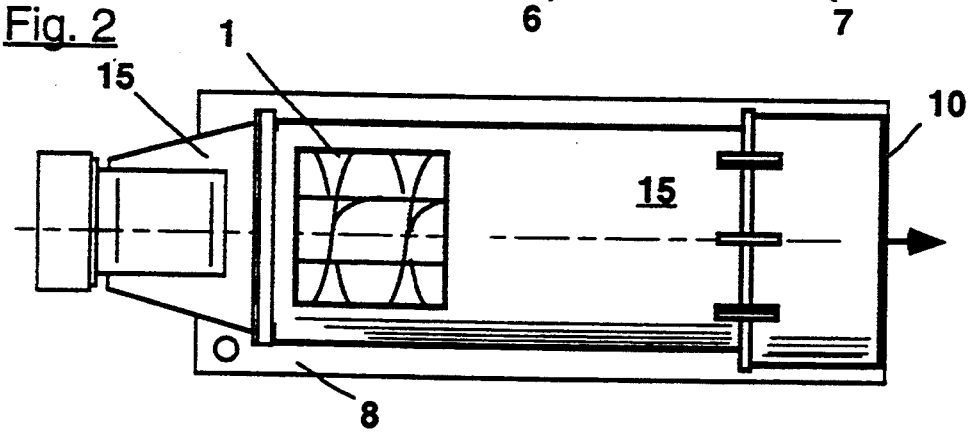
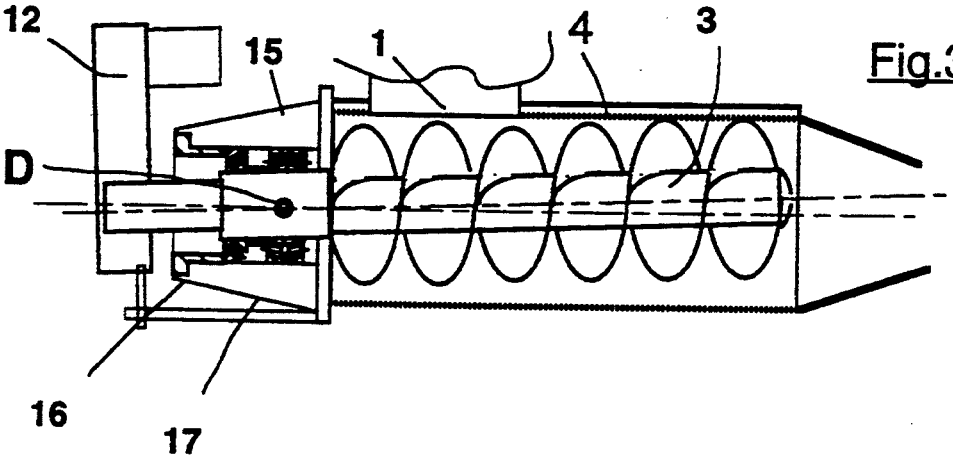
Fig.3

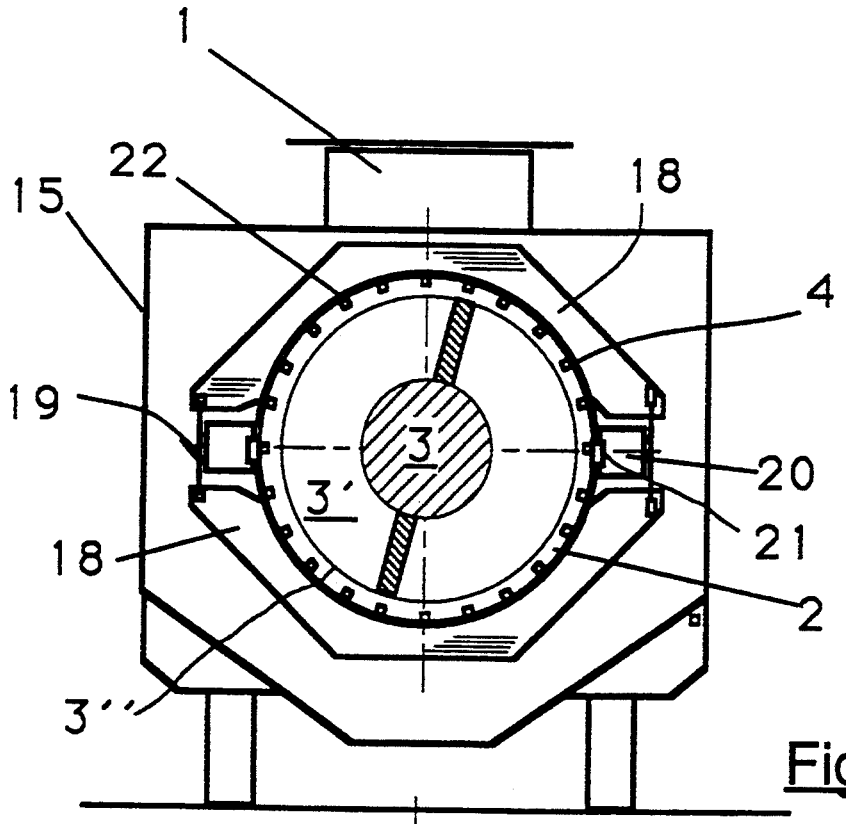
Fig.4
Fig.5
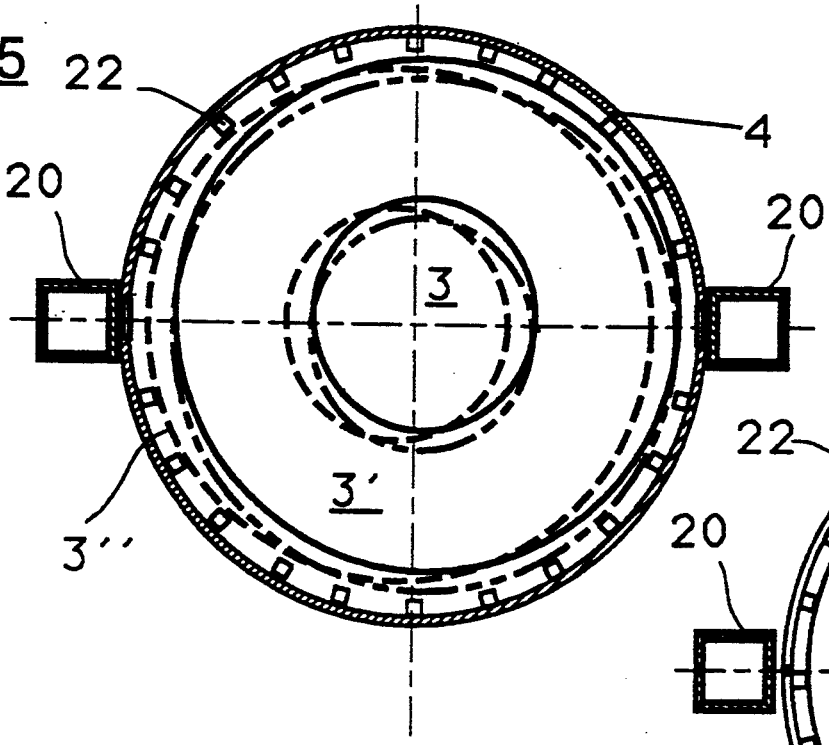
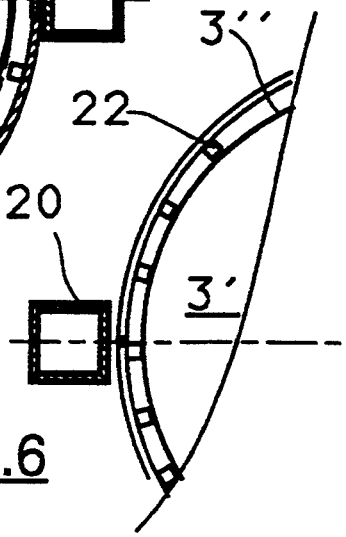
Fig.6

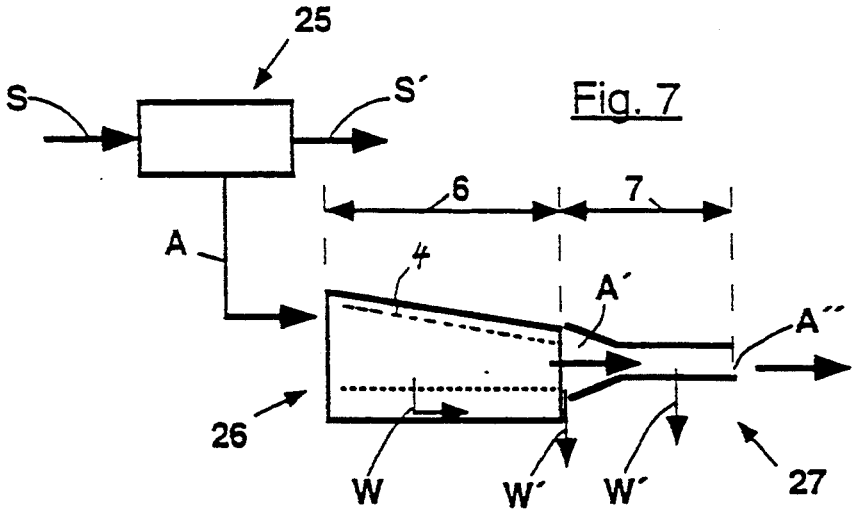
Fig. 7
Fig. 8
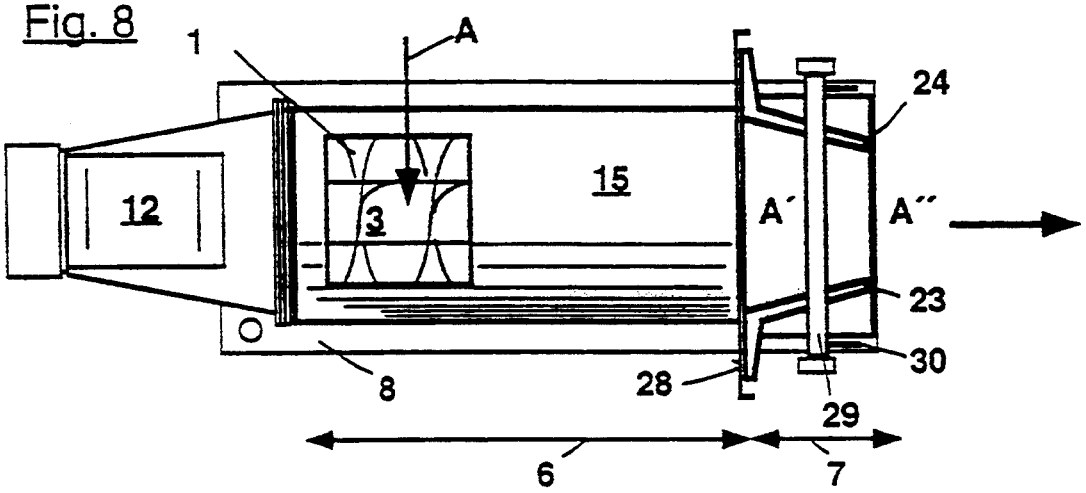
Fig.9
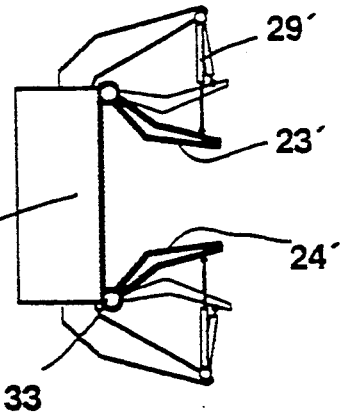
Fig.10
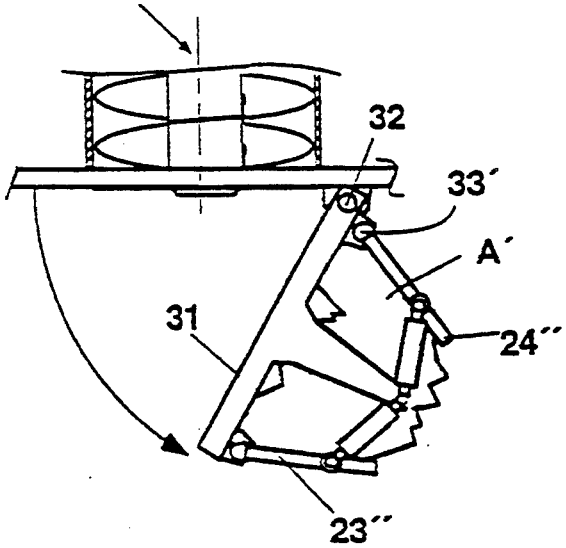

DEWATERING PRESS FOR COMPRESSIBLY DEWATERABLE MATERIAL

FIELD OF INVENTION

The invention relates to a dewatering press for compressibly dewaterable material comprising a rotatable feed screw, which is driven and mounted at the in-feed end and which is free from a physical mounting at the discharge end. The feed screw is disposed in a volume having an opening for the material in-feed through which the material (A) to be dewatered can reach the start region of the feed and dewatering section. The volume is partially bounded by a jacket provided with a multiplicity of openings, through which the water contained in the material which is to be dewatered can pass, while a substantial part of the material (A') present as solid matter is held back, this material being compacted and partially dewatered. The press further comprises a discharge located at one end of the feed section.

The operation of a dewatering press of this kind will be described in the following with reference to the example of waste obtained in the processing of used paper, but is also applicable to other compressibly dewaterable material.

TECHNICAL BACKGROUND

As is known, used or waste paper usually contains a certain proportion of unwanted stock or material which should be removed by processing for the purpose of the recycling of used paper. For this, a number of machines and processes are available to draw off as accepted stock the used paper, which is to be further processed, while the unwanted stock is removed therefrom as reject material. These reject materials are normally disposed of, or also, in special cases, reprocessed into new products. Since used paper processing normally takes place in aqueous suspension, the reject materials contain much water which makes them difficult to manipulate, and which considerably increases the transport and dumping costs for their disposal.

The mechanical separation of the water from the material by pressing has proved itself to be an economically viable and practical process. Consequently, for instance, worm presses are used in which a driven feed screw is arranged inside of a substantially concentric cylindrical or conical, perforated sheet metal jacket or the like. The reject material is fed in radially and is dewatered in cooperation with a dam apparatus, wherein the water can escape through the perforated sheet metal jacket or the like, whereas the reject materials are held back. The compression and dewatering of the reject can be improved when a conical form is chosen for the sheet metal jacket, the diameter of which reduces in the direction of movement of the reject material. Naturally, the outer worm diameter must also fit these geometrical dimensions. When the known dewatering worms are implemented as described, they are subject to a particularly large wear as a result of intensive rubbing between reject materials and the components of the machine. Namely, a considerable relative movement occurs under simultaneously enormous axial and radial forces between the already much thickened material and the components. Moreover, this reject material contains often many small metal particles and pieces of hard plastic, as well as fiber remnants which, as is known from practice, can lead to a high wear even of high quality metallic components.

PRINCIPAL OBJECT OF THE INVENTION

The object of the present invention is to form a dewatering press for compressibly dewaterable material in such a way that it is simply and clearly constructed, excessive wear at the machine parts is avoided, and simultaneously a high degree of dewatering is achievable.

BRIEF DESCRIPTION OF THE INVENTION

The object is satisfied in a dewatering press of the initially named kind in that the feed screw is mounted at the in-feed end of the press so that the angle of its center line, which extends principally in the feed direction, can vary under the action of forces which act essentially perpendicular to the feed screw's axis line.

A special advantage of the subject of the invention lies therein that the feed screw, which is subject to particularly intensive demands, is not rigidly guided, but rather can adopt a freely adjustable position within a certain range, depending on the constitution and distribution of the material which is to be pressed. In this way, simple construction, good access at the discharge (cleaning) of the press as well as favorable wear properties, in particular for screw and sieve jackets, are combined with one another. As the feed screw is radially movable relative to the sieve jacket surrounding it, the treated material in between is especially well loosened up, which leads to a better dewatering. Such advantages can be further amplified by axial strips or the like which are often provided at the inside of the sieve jacket. An excessive loading of the machine parts is reliably avoided due to the possibility of deviation or angular yielding. In additional, a particularly good and homogenous dewatering can be achieved as an even pressure distribution is possible in the area of the jacket provided with an opening.

LISTING OF FIGURES

The invention will now be described in more detail with the aid of drawings. These show:

FIG. 1 a schematic cross-section of a dewatering press in accordance with the invention FIG. 2 a plan view of the apparatus shown in FIG. 1

FIG. 3 a schematic of the subject of the invention with pivoted screw

FIG. 4 a schematic of a further advantageous embodiment,

FIG. 5 indicating three different screw positions,

FIG. 6 partial section of a variant for securing of the sieve jacket,

FIG. 7 a block diagram illustrating the operation of a special form of the dewatering press of the invention, FIG. 8 a view of a special dewatering press as seen from above, FIG. 9 a view of a discharge arrangement at the outlet of the dewatering press, and FIG. 10 a simplified representation of an opened discharge arrangement at the outlet of the dewatering press.

DESCRIPTION OF PREFERRED EMBODIMENTS

FIG. 1 shows an embodiment of a dewatering press in accordance with the invention. The material A passes through an opening 1 into the volume 2, in which the feed screw 3 with its helix 3' is present. The volume 2 is bounded by a mantle 4 which is perforated with holes 5, and which is, in this case, cylindrically constructed. The material is already dewatered, in passing through the feed section 6, not only by gravity, but also by compression which may occur during transportation. The water W runs into a dewatering container 8 via the openings 5 of the jacket 4. After having passed through the feed section 6, the material reaches the region of the discharge 9. A further compression can take place in a press section 7 connected hereto. In the case shown here, movable plates 10, 11 are placed against the material A'. Further water W' then passes into the dewatering container 8 as a result of the pressing.

The feed screw 3 is driven by drive unit 12 which, as is schematically shown, sets the shaft of the feed screw in rotation via a belt or the like. It is also recognisable that the drive unit is, in its totality, so mounted that it can participate in the rotary pendular pivoting movement of the feed screw 3.

The representation in FIG. 1 shows an example of how the mounting at the drive side end of the feed screw 3 can be effected. The bearings 16 and 17 shown can take up both the axial forces and the radial forces at this point, wherein, however, the possibility of the screw axis performing a rotary pendular movement is retained. The drive unit 12 is essentially carried by the described journalling, since it is connected with the drive side end of the feed screw 3. The torque originating from the drive force is transmitted to the housing 15 via the torque stay 13. With an appropriate construction of the machine, the lever moments at the bearings 16,17 originating from the gravity forces of the feed screw 3 and the drive unit 12 can be substantially balanced.

Even though apparatuses with horizontally lying feed and press sections have been shown, vertically or inclined arrangements are also directly conceivable, and under some conditions even advantageous.

The same press apparatus is shown in FIG. 2 as a view from above represented with a view onto the housing 15 and the in-flow opening 1.

In FIG. 3, in a sectional side view which has been somewhat exaggerated for clarity, the pivoting movement of the feed screw 3 together with the drive unit 12 is shown. The pivotal point D for this rotary pendular movement lies, as viewed axially, in the region of the bearing arrangement for the screw.

FIG. 4 shows a schematic view of the subject of the invention, wherein the viewing direction was chosen axially from outside onto the exit region of the press. The feed screw 3 with the helix 3' and the outer surface 3'' can be recognised. In this embodiment the sieve jacket 4 is shown secured to the machine frame 20 at the points 21, while a large part of the circumference of the sieve jacket is held by yokes 18, which are radially disposed opposite to one another and which themselves have a mobility, albeit limited, perpendicular to the screw axis relative to the machine frame 20. They are connected with one another by connecting elements 19. Going still further, the sieve jacket 4 can be secured so that it is only held on its end face, being otherwise movable at its longitudinal side relative to the machine frame 20 (FIG. 6). Advantageously, the sieve jacket 4 can be made out of two half cylinders which are pressed together by the yokes 18.

Furthermore, the representation of FIG. 4 shows a number of strips 22, axially secured on the inside of the sieve which serve to prevent the revolution of the material to be fed and, moreover, to protect the surface of the sieve from wear. The strips can extend exactly radially or also inclined. Their effect is also advantageous for the dewatering function of the machine, as a processing of the material between the helix 3', in particular its outer surfaces 3'', and the said strips 22 can take place as result of the rotary pendular movement of the feed screw 3.

Different positions of the pendularly rotating variable position feed screw 3 are shown in FIG. 5, enlarged and highly schematically and in the same viewing direction as FIG. 4, wherein various positions of the screw are shown by the different dotted lines. The transmission openings in the sieve jacket 4 are not shown here.

FIG. 7 shows in one diagram the individual functions which can be achieved by a special form of the apparatus in accordance with the invention. Used paper material S is processed in the processing 25, wherein waste is obtained, while the processed material S', which has been at least partially purified, is fed on. The waste, in the form of the material A which is to be dewatered, reaches a feed 26 comprising a feed and dewatering section 6. As a result of gravity and usually also by compression, water W is removed from the waste. The material A' dewatered in this way is finally subject to press processing 27 in the press section 7, and under the release of further water W' still more strongly dewatered and fed out as cork-like material A''.

FIG. 8 shows a special pressing apparatus represented in view from above, with a view onto the housing 15. The material A passes through an opening 1 into the press and is processed as already described. After having passed through the feed and dewatering section 6, it reaches the region of the discharge 12. In the press section 6 now connected thereto, the pressing elements 23 and 24 come into operation. In the case shown here, they are movable in guide ways 28 perpendicular to the feed direction of the transportation screw and are periodically pressed against the material A' by positioning motors, in particular servomotors 29. The servomotor, which is for instance hydraulically actuated, is supplied via stub pipes 30 with a pressure fluid. As a result of the pressing, further water W' reaches the dewatering container 8. Naturally, other devices for the production of pressing force are also conceivable. The now heavily dewatered material A'' can fall out of the apparatus or is driven out by the material following it. The transportation screw is driven by a drive motor 12 which, as schematically indicated, sets the shaft of the transport screw in rotation via a belt or the like.

FIG. 9 schematically represents another possibility, namely how the pressing elements 23' and 24' can be pivotably mounted on the housing 15 via hinges 33 and can be moved by servomotors 29'. The open position is shown thinner than the pressing position.

FIG. 10 shows in a simplified representation a pivotally opened discharge device in view from above. The discharge device contains a frame 31 which is openably and closeably secured to parts of the housing 15 of the dewatering press by hinges 32. This frame 31 carries hinges 33' which serve for securing of the pressing elements 23'', 24'' which have been drawn in a simplified fashion, so that these can move relative to the frame 31.

If the discharge device is swung downwardly when the dewatering press is not in use, the end of the feed screw 3 is relatively easily accessible, while the cork or plug A' can stay in the up-pivoted discharge device.

The discharge device can be once more swung into position in front of the feed screw, for instance after the completion of servicing of the dewatering press, and the operation of the dewatering screw once more initiated. As the cork A' is once more at its old position, the optimum operating condition of the dewatering press is relatively quickly achieved.

We claim:

1. A dewatering press for a compressively dewaterable material comprising:

a casing defining an elongated main chamber having an inlet for receiving the material in the chamber and an outlet for discharging the material from the chamber, the casing defining a first, longitudinal axis;

a rotatable feed screw disposed in the chamber and having an in-feed end proximate the inlet, a discharges end proximate the outlet, and a screw portion intermediate the ends for advancing the material from the inlet to the outlet when the screw is rotated;

bearing means engaging the feed screw proximate to and spaced from its in-feed end and rotatably mounting the feed screw to the casing in substantial alignment with the first axis so that the screw portion is disposed within the jacket, the bearing means permitting substantially free relative pivotal movement of the feed screw about a second axis which is generally transverse to and intersects the first axis to effect a limited deflection of the feed screw out of alignment with the first axis;

drive means coupled to the feed screw proximate its in-feed end and on a side of the bearing means opposite from the screw portion for rotating the feed screw to thereby advance the material placed into the inlet with the feed screw towards the outlet of the casing, the second axis being positioned so that moments about the second axis acting on the feed screw and generated by at least one of the weight of the feed screw and generally radially acting forces cause by the material being advanced by the screw portion results in a pivotal motion of the feed screw about the second axis; and a jacket substantially surrounding the feed screw and including a plurality of openings permitting water in the material to drain from the chamber as the rotating feed screw advances the material from the inlet to the outlet;

whereby forces generated by the material being advanced by the feed screw and acting generally transversely to the first axis on the feed screw cause a limited deflection of the feed screw about the bearing means and out of alignment with the first axis to thereby reduce forces acting on the feed screw transversely to the first axis and frictional wear of the feed screw and the jacket.

2. Dewatering press as set forth in claim 1, wherein the jacket comprises a cylindrical sheet metal sieve.

3. Dewatering press as set forth in claim 1, wherein the jacket comprises a conical sheet metal sieve.

4. Dewatering press as set forth in claim 1, wherein the jacket includes substantially axially oriented strips secured to an inner side of said jacket.

5. Dewatering press as set forth in claim 1, wherein the jacket is movably secured to the casing so that a substantial portion of said jacket is movable at least 10 mm in a direction substantially transverse to the first axis.

6. Dewatering press as set forth in claim 5, including means fixedly connecting the jacket at only one end of the jacket.

7. Dewatering press as set forth in claim 1, further comprising a discharge device coupled to said chamber for receiving material discharged from said outlet and a dam device operably coupled to said discharge device for compressing the material being discharged at said outlet to thereby further dewater the material.

8. Dewatering press as set forth in claim 1, further comprising a discharge device including a discharge chamber fluidly coupled to the outlet for holding a volume of the material discharged from the outlet, said discharge device including means for compacting the volume of the material comprising at least one pressing element movably coupled to said discharge chamber.

9. A dewatering press according to claim 1, wherein the discharge end of the feed screw is a free, unsupported end.

10. A dewatering press according to claim 1, including a discharge device having an intake communicating with the outlet and a discharge opening spaced downstream from the intake in the direction in which the material is advanced by the feed screw, and means mounting the discharge device to the casing and permitting movement of the discharge device away from the outlet of the casing while retaining a volume of the material between the intake and the discharge opening in the discharge device to provide access to the chamber from its outlet by moving the discharge device away from the outlet and to facilitate a resumption of the dewatering process when the discharge device is returned to its operative position proximate the outlet.

11. A dewatering press according to claim 10, wherein the discharge device includes a frame and means hingeably connecting the frame to the case for pivotally moving the discharge device away from and back into its operative position while retaining the volume of the material in the discharge device between its intake and its discharge opening.

12. Dewatering press as set forth in claim 10, wherein said discharge device further includes means for subjecting the volume of the material in the discharge device to pressure for further dewatering the volume of the material.

13. A dewatering press for a compressively dewaterable material comprising:

a casing defining an elongated main chamber having an inlet for receiving the material in the chamber and an outlet for discharging the material from the chamber, the casing defining a first, longitudinal axis;

a rotatable feed screw disposed in the chamber and having an in-feed end proximate the inlet and a discharge end proximate the outlet for advancing the material from the inlet to the outlet when the screw is rotated;

bearing means engaging the feed screw at its in-feed end and rotatably mounting the feed screw to the casing in substantial alignment with the first axis, the bearing means permitting limited deflection of the feed screw out of alignment with the first axis;

drive means coupled to the feed screw proximate its in-feed end for rotating the feed screw to thereby advance the material placed into the inlet with the feed screw towards the outlet of the casing;

a jacket substantially surrounding the feed screw and including a plurality of openings permitting water in the material to drain from the chamber as the rotating feed screw advances the material from the inlet to the outlet; and a discharge device including a discharge chamber fluidly coupled to the outlet for holding a volume of the material discharged from the outlet, said discharge device including means for compacting the volume of the material comprising at least one pressing element movably coupled to said discharge chamber;

whereby forces generated by the material being advanced by the feed screw and acting generally transversely to the first axis on the feed screw cause a limited deflection of the feed screw about the bearing means and out of alignment with the first axis to thereby reduce forces acting on the feed screw transversely to the first axis and frictional wear of the feed screw and the jacket.

14. Dewatering press as set forth in claim 13, wherein said at least one pressing element is movable in a direction substantially transverse to the first axis between a compacting position in which said pressing element compacts the material in said discharge chamber and a release position in which said pressing element does not compact the material in said discharge chamber.

15. Dewatering press as set forth in claim 13, including first and second pressing elements and means mounting the pressing elements for movement in a direction substantially transverse to the first axis between a compacting position in which the pressing elements compact said material in the discharge chamber and a release position in which the pressing elements do not compact the material in the discharge chamber.

16. Dewatering press as set forth in claim 13, wherein said compacting means comprises first and second hingeably mounted pressing elements, the pressing elements being pivotable between a compacting position in which they compact the material in the discharge chamber and a release position in which they do not compact the material in the discharge chamber.

17. Dewatering press as set forth in claim 13, wherein said at least one pressing element includes a plurality of openings permitting water from the material to drain therethrough when the volume of the material is being compacted.

18. Dewatering press as set forth in claim 13, wherein the discharge device includes a frame hingeably coupled to the casing, the compacting means comprising first and second pressing elements hingeably coupled to the frame, the pressing elements being pivotable between a compacting position in which the pressing elements compact the volume of the material in the discharge chamber and a release position in which the pressing elements permit the discharge of the volume of the material from the discharge device.

19. Dewatering press as set forth in claim 13, including means for pivotally moving the discharge device and the volume of the material therein towards and away from its operative position proximate the outlet.

20. A dewatering press according to claim 13, wherein the bearing means permits relative pivotal movement of the feed screw about a second axis which is generally transverse to the first axis to effect said limited deflection of the feed screw.

21. A dewatering press according to claim 20, wherein the bearing means include a bearing permitting limited pivotal movement of the feed screw about a plurality of second axes all of which are substantially transverse to the first axis so that the feed screw can prescribe a limited rotary pendular movement about the first axis.

22. A dewatering press according to claim 21, including means coupling the drive means to the feed screw so that the drive means moves with the feed screw during said limited rotary pendular movement about the first axis.

23. A dewatering press for a compressively dewaterable material comprising:

a casing defining an elongated main chamber having an inlet for receiving the material in the chamber and an outlet for discharging the material from the chamber, the casing defining a first, longitudinal axis;

a rotatable feed screw disposed in the chamber and having an in-feed end proximate the inlet, a discharge end proximate the outlet, and a screw portion intermediate the ends for advancing the material from the inlet to the outlet when the screw is rotated;

bearing means rigidly attached to the casing, engaging the feed screw proximate to and spaced from its in-feed end and rotatably mounting the feed screw to the casing in substantial alignment with the first axis so that the screw portion is disposed within the jacket;

pivot means associated with the bearing means and permitting substantially unrestrained pivotal movement of the feed screw relative to the bearing means and the casing about a second axis which is generally transverse to and intersects the first axis to effect a limited deflection of the feed screw out of alignment with the first axis when the feed screw is subjected to an unbalanced, radially acting force;

drive means coupled to and carried by the feed screw proximate its in-feed end and on a side of the bearing means opposite from the screw portion for rotating the feed screw to thereby advance the material placed into the inlet with the feed screw towards the outlet of the casing; and a jacket substantially surrounding the feed screw and including a plurality of openings permitting water in the material to drain from the chamber as the rotating feed screw advances the material from the inlet to the outlet;

whereby forces generated by the material being advanced by the feed screw and acting generally transversely to the first axis on the feed screw cause a limited deflection of the feed screw relative to the bearing means and out of alignment with the first axis to facilitate the dewatering of the material.

* * * * *